United States Patent [19]

Brown

[11] 4,079,721

[45] Mar. 21, 1978

[54] SAFETY CUT-OFF FOR INTERNAL COMBUSTION ENGINE

[76] Inventor: Graham M. Brown, 9 Purcell Dr., Billerica, Mass. 01821

[21] Appl. No.: 717,567

[22] Filed: Aug. 26, 1976

[51] Int. Cl.[2] ..... F02B 77/08

[52] U.S. Cl. ..... 123/198 DC; 123/182; 123/169 V

[58] Field of Search ..... 123/182, 146.5 B, 146.5 D, 123/151, 152, 198 DC, 198 D, 169 V

[56] References Cited

U.S. PATENT DOCUMENTS

| | | | |
|---|---|---|---|
| 873,747 | 12/1907 | Hedstrom | 123/182 |
| 962,653 | 6/1910 | Morrill | 123/182 |
| 1,492,007 | 4/1924 | Wayte | 123/182 |
| 1,925,086 | 9/1933 | Snyder | 123/182 X |
| 2,362,838 | 11/1944 | Mallory | 123/182 X |
| 2,534,860 | 12/1950 | Fisher | 123/182 |
| 2,778,349 | 1/1957 | Thommen | 123/182 X |

*Primary Examiner*—Charles J. Myhre
*Assistant Examiner*—Ira S. Lazarus
*Attorney, Agent, or Firm*—E. Thorpe Barrett

[57] ABSTRACT

A safety cut-off for a two-cycle gasoline engine in which a common actuating arm both causes an interruption of the ignition circuit and operates a valve to release pressure from the combustion chamber.

4 Claims, 6 Drawing Figures

SAFETY CUT-OFF FOR INTERNAL COMBUSTION ENGINE

Two-cycle, single cylinder engines, such as are in extensive use on lawn mowers, snow blowers, motor boats, etc., are stopped by interrupting the ignition circuit. This is a satisfactory method of operation under general conditions of use, but if it is necessary to work on moving parts connected to the engine immediately after stopping it, there is risk of injury because the combustion chamber is still under pressure.

It is an object of this invention to provide a safety cut-off for stopping an internal combustion engine by interrupting the ignition circuit and, by the same actuating mechanism, releasing the pressure from the combustion chamber.

It is a further object of the invention to provide a safety cut-off in which a valve is arranged to communicate with the internal chamber of a spark plug and thereby to permit release of the compression through the internal chamber of the spark plug.

Another object is to provide such a safety cut-off including a connector in threaded engagement with the cylinder head port ordinarily occupied by the spark plug and which is itself in threaded engagement with the spark plug and which also communicates with a valve actuated by an arm that is arranged also to disconnect the electrical circuit to said spark plug whenever the arm is moved to open the valve.

These and other objects will be in part pointed out and in part apparent from the following description considered in conjunction with the accompanying drawings in which.

Figure 1:
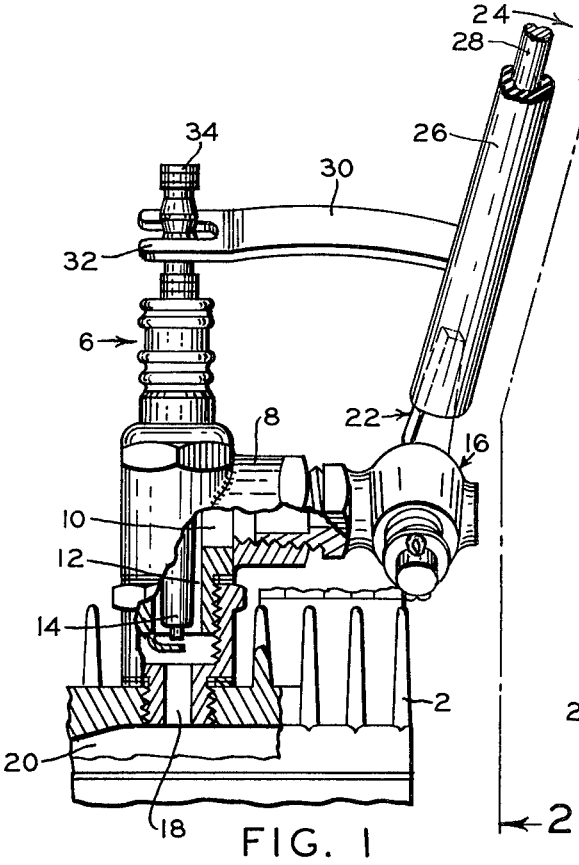
FIG. 1 is a diagrammatic view of a safety cut-off embodying the invention, part of the structure being cut away to show the internal arrangement.

As shown in FIG. 1, a cylinder head 2 is provided, in the usual manner, with an internally-threaded port 4 for receiving a spark plug 6. This spark plug 6 is a conventional plug except that it is provided with a laterally extending collar 8 having an internal opening 10 that communicates with the internal chamber 12 that surrounds the ceramic insulator 14 of the spark plug. A conventional cut-off valve, generally indicated at 16, is in threaded engagement with the collar 8 and communicates with the internal opening 10 in the collar 8 and through the internal chamber of the spark plug 6 to a port 18 into the compression chamber 20. The valve 16 is operated by an arm 22, movable in the direction indicated by the arrow 24. In the position shown in FIG. 1, the valve 16 is closed so that compression is maintained in the cylinder.

An insulating sleeve 26 is firmly connected to and serves as an extension of the arm 22. Beyond the end of the arm 22, and within the sleeve 26, an ignition lead 28 makes electrical connection with a disconnect member 30, preferably formed of spring metal, having a furcated end portion 32 that straddles and engages the center electrode terminal 34 of the spark plug 6. The ignition lead 28 is connected to a high voltage ignition system in the usual manner.

In operation, the engine is stopped by grasping the insulating sleeve 26 and moving it in the direction indicated by the arrow 24 in FIG. 1, this single motion both opening the valve 16 and removing the disconnect member 30 from engagement with the electrode 34. The ignition circuit is thus opened and the pressure in the cylinder 20 is relieved. All danger of accidental ignition or compressional surge of the engine is eliminated.

Figure 4:
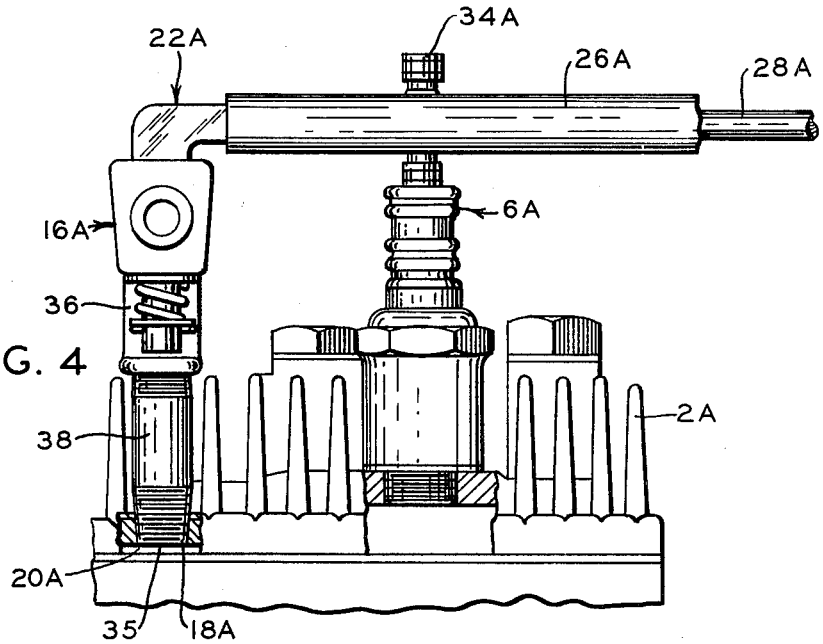
FIG. 4 is an elevational view of another arrangement of the safety cut-off in which separate ports are used for ignition and compression release, part of the structure being cut away to show the internal arrangement.
Figure 5:
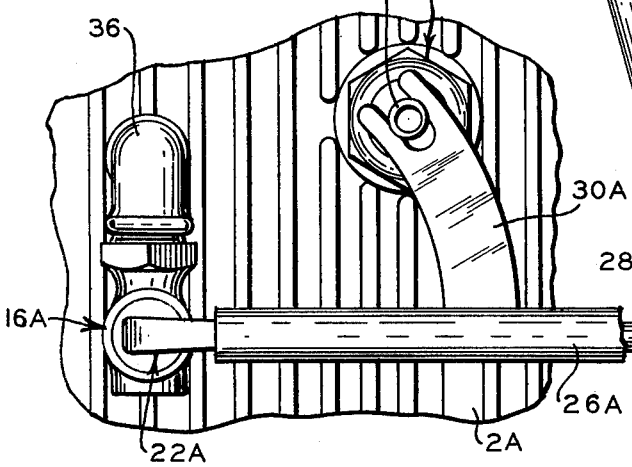
FIG. 5 is a plan view of the safety cut-off shown in FIG. 4.

In FIGS. 4 and 5, in which similar parts are indicated by the same numbers followed by the suffix A, another arrangement is shown in which the pressure is relieved through a port 35 separate from the spark plug 6A. The valve 16A and the arm 22A are functionally the same as in the previous arrangement. The disconnect member 30A is arcuate and engages the spark plug electrode 34A as before. The valve 16A is in threaded engagement with a pipe elbow 36 which, through a coupling 38 in threaded engagement with the port 18A, communicates with the cylinder chamber 20A. In operation, the engine is stopped by rotating the arm 22A in the direction shown by the arrow 24A, disconnecting the ignition and opening the valve 16A.

Figure 2:
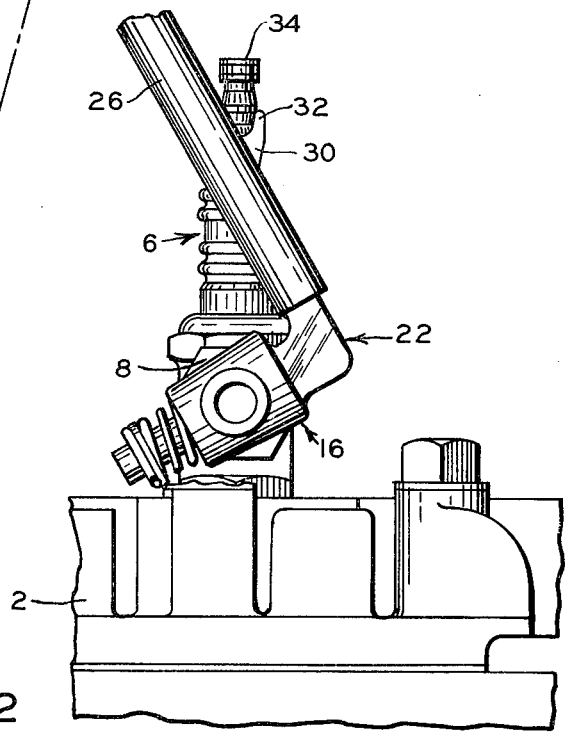
FIG. 2 is an elevational view of the safety cut-off shown in FIG. 1.
Figure 3:
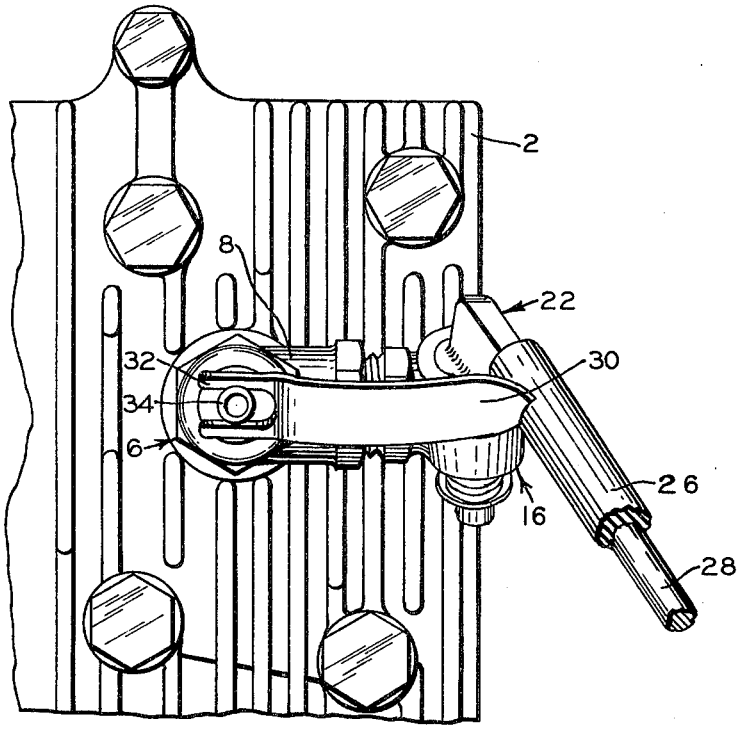
FIG. 3 is a plan view of the safety cut-off shown in FIG. 1.
Figure 6:
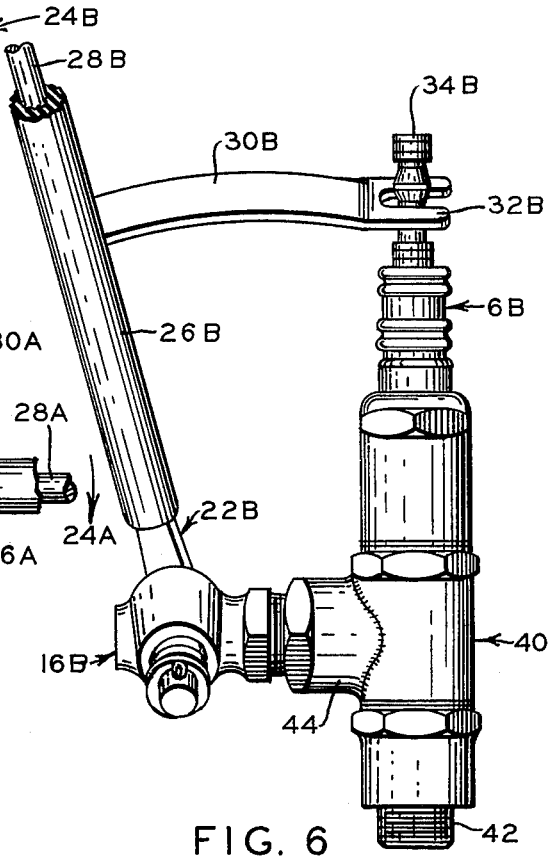
FIG. 6 is a diagrammatic elevational view of a preferred embodiment of the invention utilizing a standard spark plug and a common cylinder head port for ignition and pressure release.

In the arrangement illustrated by FIGS. 1, 2, and 3 it is necessary to provide a special spark plug arranged to carry the valve 16 in communication with the internal chamber 12 of the plug. In the arrangement illustrated by FIGS. 4 and 5, it is necessary to provide a second port in the cylinder head of the engine. In the preferred embodiment illustrated in FIG. 6, in which similar parts are indicated by the same numbers followed by the suffix B, a standard plug is used and no additional port is necessary.

A T-pipe connector 40 has a threaded male extension 42 adapted to be received by the spark plug port in the cylinder head. The opposite end of the connector 40 has a threaded female opening adapted to receive a conventional spark plug 6B. A horizontal extension 44 of the connector 38 is threaded to receive the valve 16B, which is the functional equivalent of the valve 16 of FIG. 1. As before, an arm 22B carries the disconnect member 30B that engages the center electrode terminal 34B of the spark plug 6B. When the arm 22B is moved in the direction of the arrow 24B, the member 30B is disengaged from the electrode 34B and the valve 16B is opened to release the cylinder pressure. Thus the safety cut-off can be installed on a conventional engine without providing a special spark plug or an additional port in the cylinder head. The spark plug is removed from the engine and replaced by the T-connector 40B and the spark plug is re-installed in the upper end of the T-connector.

From the foregoing it will be apparent that my invention is well adapted to meet the ends and objects herein set forth and apparent from the description, to be economically manufactured, and is subject to a variety of modifications to best adapt it to suit the requirements of each particular application.

I claim:

1. In an internal combustion engine, a safety cut-off comprising a combustion chamber, a cylinder head communicating with said combustion chamber, a port in said cylinder head communicating with said chamber, a valve having an open and a closed position and having when in said open position a continuously open path permitting the bidirectional passage of gases therethrough, said path being positively closed when said valve is in said closed position, means connecting said valve with said port, and electrical ignition circuit communicating with the interior of said chamber including in series therewith an ignition disconnect switch arranged to interrupt the electrical continuity of said circuit, an actuating arm operatively connected to said valve and to said ignition disconnect switch and having a first position and a second position, said arm being arranged when in said first position to close said valve and complete said ignition circuit and when in said second position to interrupt said ignition circuit and open said valve thereby to stop the operation of said engine and release the pressure within said chamber and permit the bidirectional flow of gases into and out of said chamber.

2. A safety cut-off as claimed in claim 1 including a connector in threaded engagement with said port and communicating with said valve and wherein said ignition circuit includes a spark plug in removable threaded engagement with said connector, and said ignition disconnect switch comprises a conductor in releasable engagement with said spark plug.

3. A safety cut-off as claimed in claim 1 including a spark plug having an internal chamber in communication with said combustion chamber and means connecting said valve through a side wall of said spark plug into communication with said internal chamber of said spark plug.

4. In an internal combustion engine, a safety cut-off comprising a spark plug having a side wall and an internal chamber, a laterally extending collar attached to said side wall of said spark plug and communicating with said internal chamber, and a valve secured to and supported by said collar, whereby the pressure in said engine can be released or retained by operation of said valve.

* * * * *